United States Patent [19]

Sharpe

[11] 4,349,108

[45] Sep. 14, 1982

[54] CONTAINERS

[75] Inventor: Derrick Sharpe, Chesterfield, England

[73] Assignee: W. H. D. Development Limited, Langwith Junction, England

[21] Appl. No.: 141,122

[22] Filed: Apr. 17, 1980

[30] Foreign Application Priority Data

Apr. 19, 1979 [GB] United Kingdom ..... 7913659

[51] Int. Cl.[3] ..... B65D 21/04

[52] U.S. Cl. ..... 206/506; 220/1.5; 414/30; 414/137; 414/140

[58] Field of Search ..... 414/30, 786, 137, 139, 414/140; 410/31, 32, 33, 43, 71, 72, 78, 156; 206/506, 507, 448, 599, 386; 220/1.5; 114/72

[56] References Cited

U.S. PATENT DOCUMENTS

| | | | |
|---|---|---|---|
| 1,308,036 | 7/1919 | Boyd | 206/506 |
| 2,803,369 | 8/1957 | Fleetwood | 206/506 X |
| 3,379,339 | 4/1968 | Asenbauer | 206/507 X |
| 3,691,595 | 9/1972 | Buckteman et al. | 220/1.5 X |
| 3,981,410 | 9/1976 | Schurch | 220/1.5 X |
| 4,195,744 | 4/1980 | Christianson | 220/1.5 |

FOREIGN PATENT DOCUMENTS

| | | | |
|---|---|---|---|
| 2007788 | 8/1971 | Fed. Rep. of Germany | 206/506 |
| 2314870 | 1/1977 | France | 206/506 |
| 2342211 | 9/1977 | France | 220/1.5 |

*Primary Examiner*—Leslie J. Paperner

*Attorney, Agent, or Firm*—Owen, Wickersham & Erickson

[57] ABSTRACT

A method of improving industrial production comprising the steps of arranging a plurality of full containers in a transporter, the container being arranged in a predetermined number of stacks of containers, each stack containing a predetermined number of containers, transporting the containers in said configuration to a destination, unloading the containers from the transporter and thereafter introducing the same, or substantially the same, number of containers into the transporter as were transported thereby to said destination but said containers being arranged in a plurality of columns of nested containers, the number of columns being less than said predetermined number of stacks and the space not occupied by the columns of steel containers being utilized to transport other articles to a further destination. Each container comprises a load receiving body, adapted to nest in the body of a similar container, and retractable leg means movable between an operative position, in which the weight of the body is supportable on the legs and a similar container can be stacked above the said container with the weight of said similar container being transmitted to the legs of said one container, and an inoperative position in which the bodies are permitted to nest.

11 Claims, 17 Drawing Figures

CONTAINERS

BACKGROUND OF THE INVENTION

FIELD OF THE INVENTION

This invention relates to containers for use in the transport of goods. There is today widespread use of large containers into which a plurality of individual articles to be transported are loaded, for example, at the factory. The loaded containers are then transported, for example, on specially adapted road or rail vehicles to a dockside and are then lifted on board a ship adapted to receive such containers. After arrival of the ship at the port of destination, the containers are lifted off and transported to their intended recipient by road or rail transport.

Such containers are generally of box shape and about 6 meters (20 feet) long×2.4 meter (8 feet) high×2.4 meter (8 feet) wide although other dimensions (particularly length, which is typically between 3.0 and 12.2 meters (10 and 40 feet) and height may be utilised.

It is frequently found in international trade that containers are carried full to a port of destination but empty from that port. For example, containers are used to transport manufactured goods from Europe to Middle Eastern countries from where manufactured goods are not exported on the same scale. Thus there is a significant extent of "dead heading" of containers from such a port of destination to another port where the containers can be refilled; this is uneconomic.

SUMMARY OF THE INVENTION

An object of the invention is to provide a new and improved container whereby the cost of "dead heading" can be reduced.

According to one aspect of the invention we provide a container comprising a load receiving body, adapted to nest in the body of a similar container, and retractable leg means movable between an operative position, in which the weight of the body is supportable on the legs and a similar container can be stacked above the said container with the weight of said similar container being transmitted to the legs of said one container, and an inoperative position in which the bodies are permitted to nest.

When a plurality of containers embodying the first aspect of the invention are full, they are stacked in a transporter, such as a ships hold, with the bottoms of the legs of one container engaging the container below and with the bottom legs of the lowermost container engaging the floor of the transporter. The whole of the load carrying space of the transporter is thus occupied by stacks of full containers. There may be, for example, nine containers in a stack. However, when the containers are to be transported empty, from a port of destination, the legs are moved to their inoperative position and the container bodies are nested but with the bottom container of the nested column having its legs in the operative position to transport the weight of the column to the floor. Thus, in the space occupied by a single stack of nine containers, thirty three containers can be nested and so the space occupied by four stacks of containers is occupied by one column of thirty three nested containers and a short column of three nested containers.

If there are, for example, eleven stacks of nine containers, that is a total of ninety nine containers, these can be transported empty in three columns of thirty three nested containers. The volume of the transporter which would otherwise have been occupied by ninety containers being free to be used for other purposes such as the transport of non-containerisable goods such as bulk goods, for example grain, soya beans or the like.

According to another aspect of the invention we provide a transporter having a storage space capable of containing a predetermined number of stacks, each stack containing a predetermined number of stacked, but nestable, containers, all or substantially all, said containers being in said space but arranged in a plurality of columns of nested containers, the number of columns being less than said predetermined number of stacks and the space not occupied by the columns of steel containers being occupied by other articles.

According to a further aspect of the invention we provide a method of improving industrial production comprising the steps of arranging a plurality of full containers in a transporter, the containers being arranged in a predetermined number of stacks of containers, each stack containing a predetermined number of containers, transporting the containers in said configuration to a destination, unloading the containers from the transporter and thereafter introducing the same, or substantially the same, number of containers into the transporter as were transported thereby to said destination but said containers being arranged in a plurality of columns of nested containers, the number of columns being less than said predetermined number of stacks and the space not occupied by the columns of steel containers being utilised to transport other articles to a further destination.

In all aspects of the invention, each container may comprise a body comprising an open topped box having downwardly and inwardly inclined side walls whereby the body of a similar container can be nested therein and a plurality of legs pivotally connected at or adjacent their upper ends to the body at or adjacent the upper end thereof, for movement between an operative position in which the legs extend generally downwardly and are adapted to carry the weight of the body and to transmit the weight to the top of the legs of a similar container therebelow upon which said one container is stacked, and an inoperative position in which they extend generally parallel to the top of the container and in which the bodies can be nested.

BRIEF DESCRIPTION OF THE DRAWINGS

The invention will now be described in more detail by way of example with reference to the accompanying drawings wherein.

DESCRIPTION OF THE PREFERRED EMBODIMENTS

Figure 1:
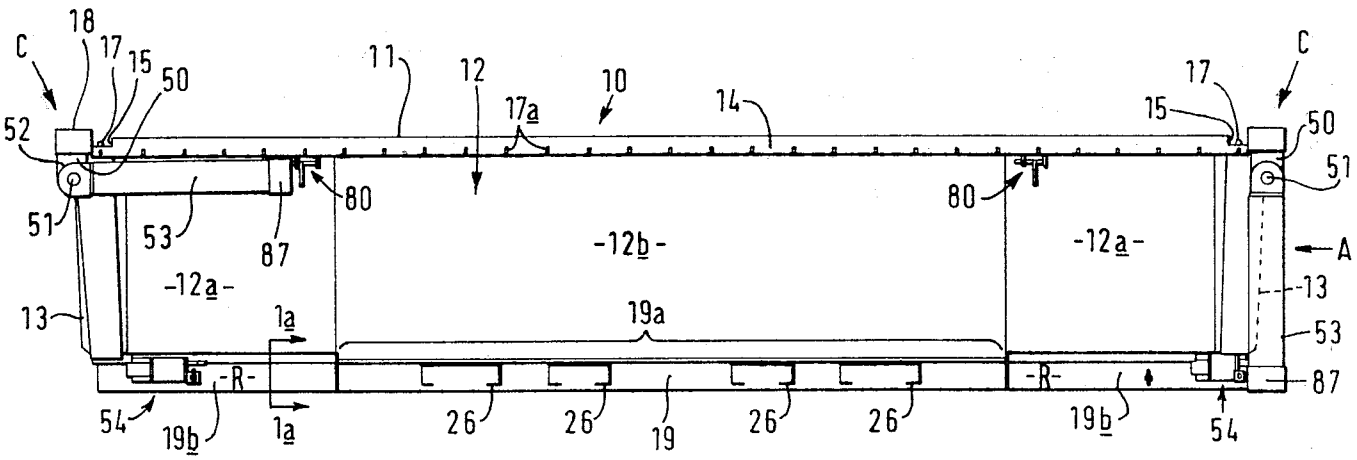
FIG. 1 is a side elevation of one embodiment of a container embodying the present invention and showing, in the right hand side of the Figure, a leg in its operative position and, in the left hand side of the Figure, a leg in its inoperative position.
Figure 2:
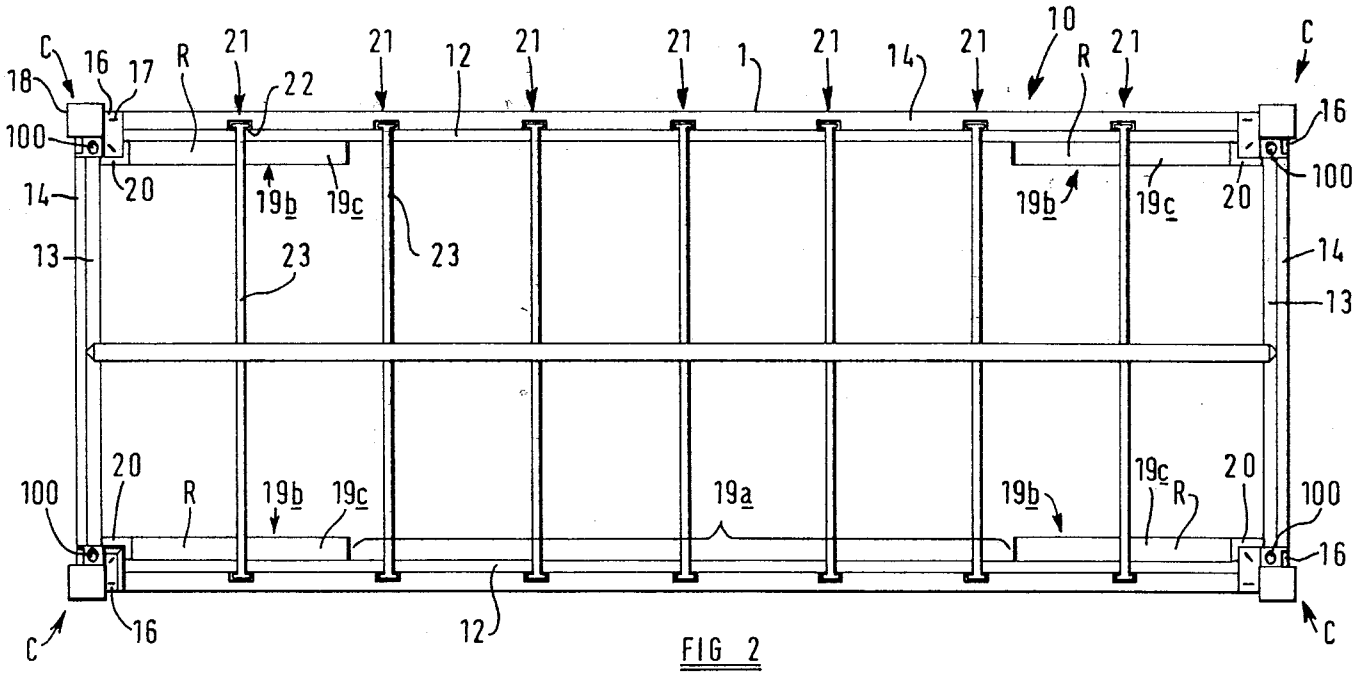
FIG. 2 is a plan view of the container of FIG. 1.
Figure 3:
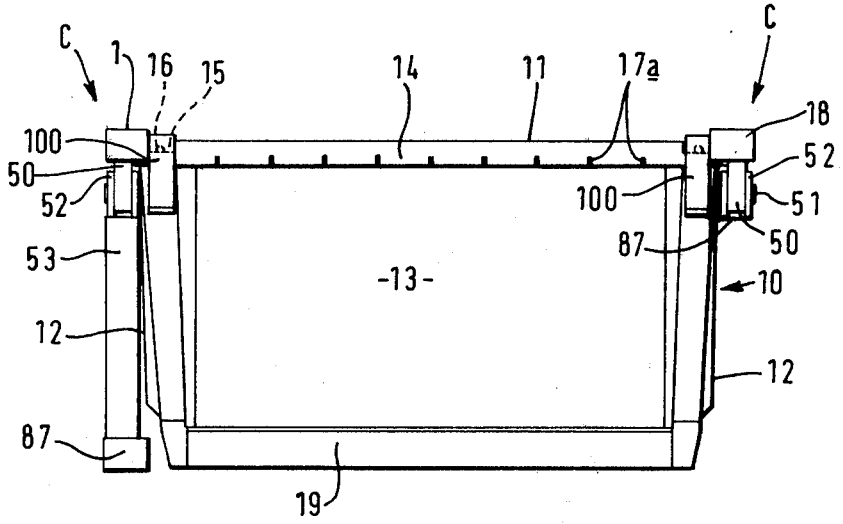
FIG. 3 is an end elevation of the container of FIG. 1 looking in the direction of arrow A and showing in the right hand side of the Figure, the leg of FIG. 1 in its inoperative position and in the left hand side of the Figure, another leg of the container in its operative position.

Referring to the Figures, and in particular to FIGS. 1 to 3, where the pattern of ribbing is not illustrated for clarity, a container embodying the invention is indicated generally at 10 and comprises a body 11 in the form of an open-topped box having long side walls 12 and end side walls 13, each of which is inclined downwardly and inwardly to provide a body 11 of tapered configuration and rectangular in horizontal section. Thus, the body of a similar container can be nested within the body of the container shown in FIG. 1 and likewise the container shown in FIG. 1 can be nested within the body of a similar container.

In the example illustrated, the container is made of welded plate steel and is provided with reinforcing box section beams 14 at its upper end arranged to provide a rectangular, in horizontal section, reinforcing frame. Adjacent the corners C the box section beam is of reduced height as indicated at 15 and a plate 16 is welded thereto and carries eyes 17 for the securement of a canvas cover.

Also at the corners C, corner boxes 18 are welded to the ends of the beams 14 directly in the case of the beams 14 extending along the long sides and via twistlocks 100 in the case of the beams 14 extending along the end sides.

The sheet metal long side and end side walls 12, 13 are welded at their upper ends to the inwardly facing vertical surface of the beams 14 and extend downwardly and inwardly therefrom and at their lower ends are secured to base beams 19. The sheeting of the long side and end side walls 12, 13 terminates at the beginning of the reduced height parts 15 of the beams 14 and an angle section corner member 20 is welded thereto and to the plate 16 and to the bottom beams 19.

At equally spaced locations 21, the beams 14 associated with the long side walls 12 are provided with pockets, open at the top, closed at the bottom and having a vertical slot 22 in which are received the T-shaped ends of removable cross braces 23.

Figure 1A:
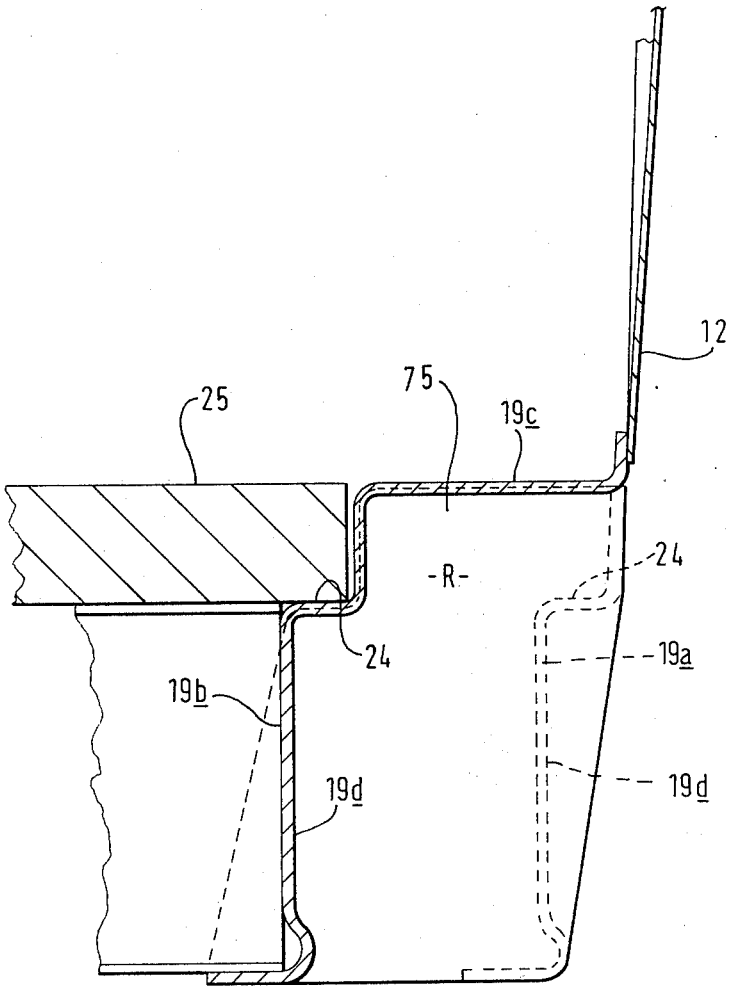
FIG. 1*a* is a section, on the line A—A of FIG. 1, to an enlarged scale.

Referring now to FIG. 1*a*, it will be seen that over the majority of their length, the bottom beams 19 provide a shallow rebate 24 in which is supported a timber floor 25 of the container and as shown in FIG. 1, cross beams 26 of channel configuration are provided beneath the floor to support the floor and brace the container.

Figure 4:
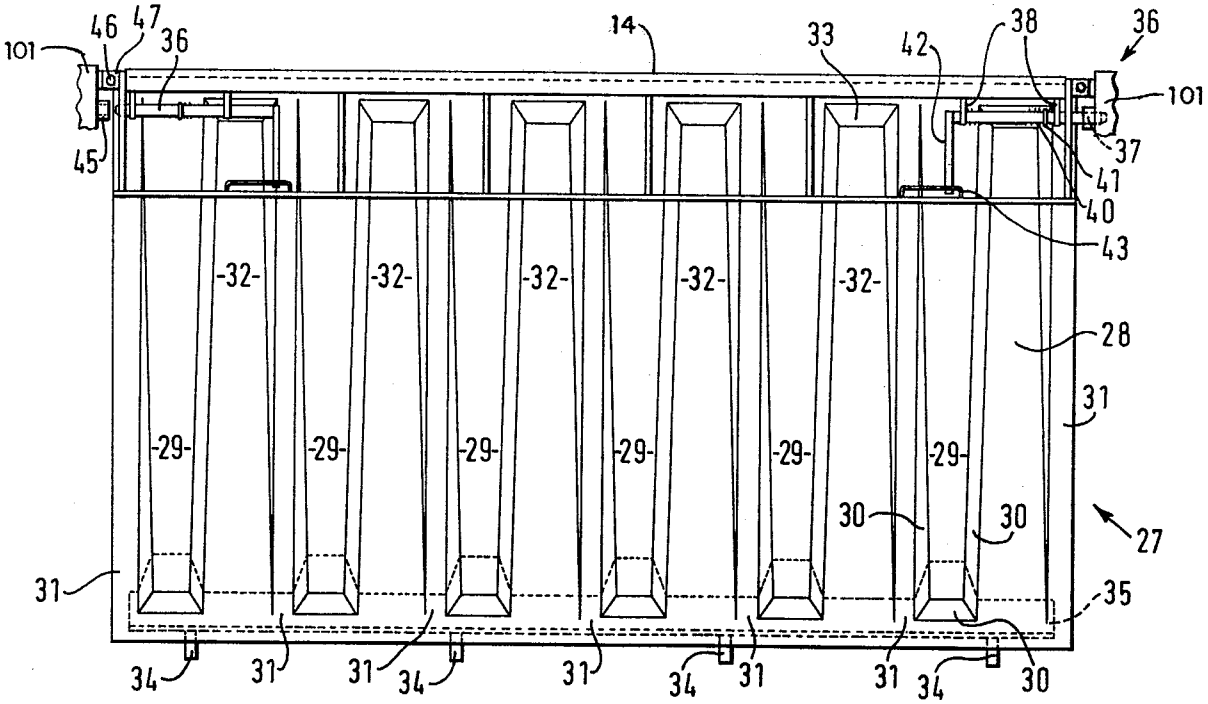
FIG. 4 is an end elevation of part of the container of FIG. 1 and illustrating a ramp end thereof.

At the left hand end of the container, the end wall 13 is provided in the form of an end ramp 27 illustrated in FIG. 4, which comprises a steel sheet 28 of the ribbed configuration shown in FIG. 4 namely comprising six ribs 29, having tapering side and base walls 30, which project outwardly, relative to the interior of the container, from a median plane of the sheet in which lie parts indicated at 31 and further ribs 32 which project inwardly, relative to the interior of the container, from the median plane and also have tapering side and top walls 33.

At its lower end, the sheet 28 carries apertured lugs 34 which receive a pivot pin (not shown) received in apertured lugs (not shown) welded to the end base member 19.

A reinforcing plate 35 is provided between the lugs 34 and the sheet 28.

At its upper end, the end ramp 27 carries securing bolts 36, one of which is shown in its operative position at the right hand side of FIG. 4 and, the other of which is shown in its inoperative position at the left of FIG. 4. The bolt 36 comprises a generally cylindrical bolt member 37 slidably mounted in apertured lugs 38 welded to a reinforcing box section beam 14 secured to the sheet 28.

A coil compression spring 40 normally biases the bolt member 37 to its operative position as a result of engagement of the spring between the left hand lug 38 and a flange 41 provided on the bolt member. The bolt 36 has a handle 42, the free end of which is received within a slot in a stirrup member 43, the slot having a transversely extending portion at its inner end whereby the bolt can be maintained in its operative position shown in the left hand side of FIG. 4.

A tubular socket 45 is welded to twist lock housings 101 on the corner boxes 18 to receive the end of the bolt member 37 when it is in its operative position. An anti-rack peg 46 is also welded to the associated housing 101 and is received within an aperture provided in a lug 47 secured to the ramp 27. As a result, movement between the ramp 27 and the box 18 is prevented when the ramp is in its closed position.

Referring now again to FIGS. 1 and 2, the bottom long side beams 19 over the majority of their length i.e. the region indicated at 19*a*, are of the configuration described hereinbefore and illustrated in dotted line in FIG. 1*a* and designated 19*a* therein. Adjacent the corners C however the bottom beams 19 are of the full line configuration shown in FIG. 1*a* and referred to therein as 19*b* and it will be seen that the beam parts 19*b* have an outwardly projecting flange portion 19*c* so that the rebate 24 and a web part 19*d* are displaced inwardly compared with the position they occupy over the majority of the length 19*a*. Thus adjacent the corners C, a recess R is formed.

The long side walls above the region 19*a* of the bottom beams, comprise sheeting which is of a ribbed configuration having ribs projecting from a median plane of the sheet inwardly and outwardly relative to the interior of the container. The pattern of ribbing may, for example, be identical to that provided, and described hereinbefore, on the sheet 28 of the end ramp 27. The sheet may be made by welding together individual panels of the configuration shown in FIG. 5*a* or the sheet may be made of greater width but formed to the same profile and if desired the whole of the region 19*a* may be covered by a single sheet of the desired profile.

Figure 5A:
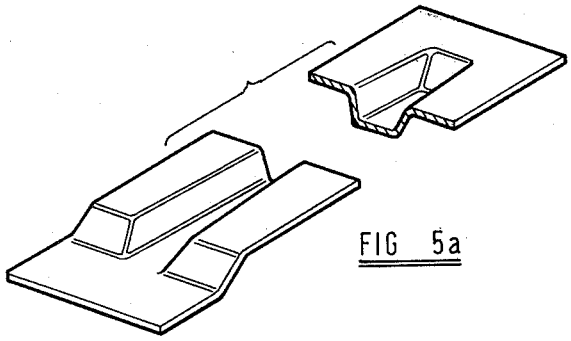
FIGS. 5*a*, 5*b* and 5*c* are fragmentary perspective views illustrating alternative configurations of sheeting for use in the container of FIG. 1.
Figure 5B:
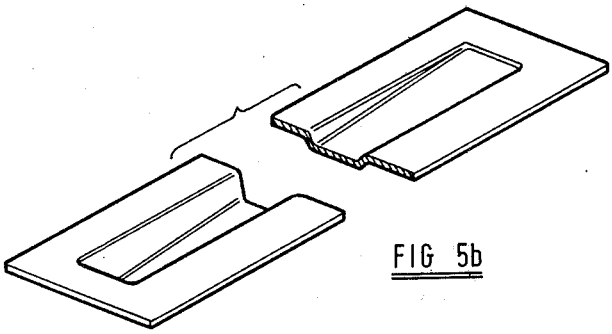
Figure 5C:
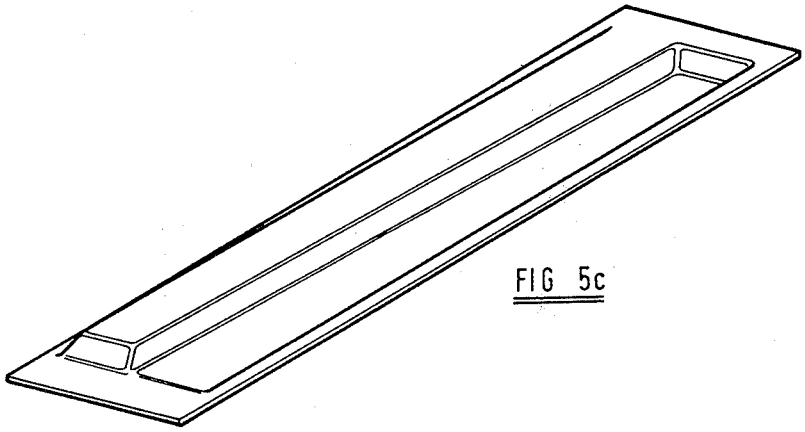

Instead of the profile illustrated in FIG. 5*a*, this portion of the sheeting could be made by securing together individual panels of the configuration shown in FIG. 5*c*.

The long side walls above the portions 19*b* of the bottom beams are of a different configuration in that they are provided with ribs which project only into the interior of the container and hence are made up from individual panels of the configuration shown in FIG. 5*b*. Again, if desired, the sheet above the region 19*b* may be made from panels of greater width or from a single panel covering the whole width but formed to repeats of the configuration shown in FIG. 5*b*.

It will be appreciated that by providing sheeting of the configuration described above in the region above the bottom beams 19*b*, the overall width of the side walls is reduced in this region, indicated at 12*a*, compared with the overall width in the region above the portion 19*a* and indicated at 12*b*.

It will be appreciated that because of the downwardly and inwardly tapering configuration of the side and end walls 12, 13, and of the above described rib configuration, it is possible for containers identical to that shown in the Figures to be nested one within the other with the ribs of the corrugations of the long side and end side walls nesting within each other.

The end wall 13 shown in FIG. 3 is of the same configuration as that shown in FIG. 4 except that it is a fixed end wall and not a ramp end. If desired, the end shown in FIG. 3 could be arranged to provide a ramp end in a similar manner to that shown in FIG. 4.

It will be appreciated that the pattern of ribbing provided on the end and side walls may be varied from that described hereinbefore so long as the essential requirement of nesting is achieved.

Each corner box 18 has a mounting lug 50 depending downwardly from its undersurface and carrying a pivot pin 51 which is received in trunnions 52 provided at the upper end of legs 53. Each corner box 18 thus effectively provides a further, fixed, leg part to provide in combination with the leg 53 a leg means.

As can be seen by comparing the left and right hand sides of FIG. 1 and of FIG. 3, the container is thereby provided with four legs at each of its corners, each leg being movable between an inoperative position shown at the left hand side of FIG. 1 and the right hand side of FIG. 3, and an operative position shown at the right hand side of FIG. 1 and the left hand side of FIG. 3.

When the legs 53 are in their operative position, they are locked in that position by a locking mechanism indicated generally at 54 and shown in an inoperative condition at the left hand side of FIG. 1 and an operative condition at the right hand side of FIG. 1. The locking mechanism is described in more detail with reference to FIGS. 6 and 7 and comprises an arm 55 pivoted at one end by a pivot pin 56 to a lug 57 projecting outwardly from the bottom beam 19*b*.

At its other end, the arm 55 has an abutment surface 58 for engagement with a side wall portion 59 of the leg 53 and has a slot 60 provided in an extension plate 61 fixed to the main part of the arm 55. A generally rectangular bolt member 62 is mounted in a socket 63 fixed to the leg 53 for sliding movement in a vertical direction into and out of the slot 60. A stop 64 is provided to prevent removal of the bolt member 62 from the socket 63 and the bolt member is apertured at 62 to facilitate a manual movement of the bolt member into and out of the aperture 60.

The arm 55 also carries an apertured lug 65 which, in the inoperative position of the arm, co-operates with a toggle fastener 66 provided on the beam 19*b* to hold the arm 55 in its inoperative position.

Figure 6:
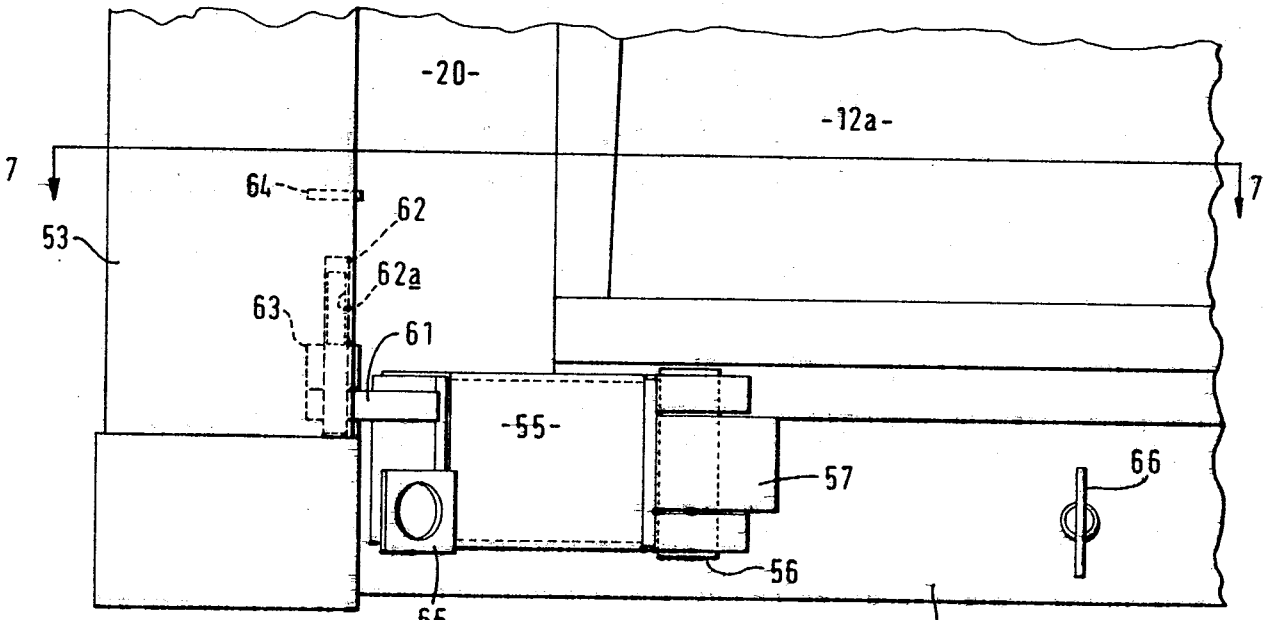
FIG. 6 is a fragmentary side elevation, to an enlarged scale, of part of the container of FIG. 1, showing a locking mechanism.
Figure 7:
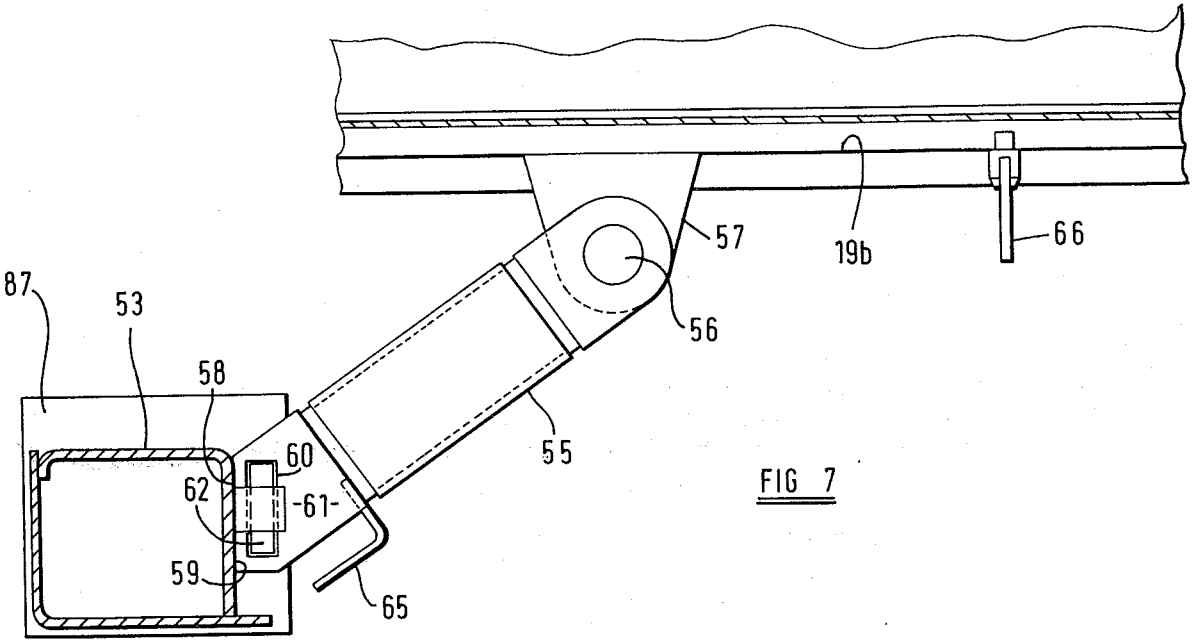
FIG. 7 is a plan view, partly in section on the line 7—7 of FIG. 6.
Figure 8:
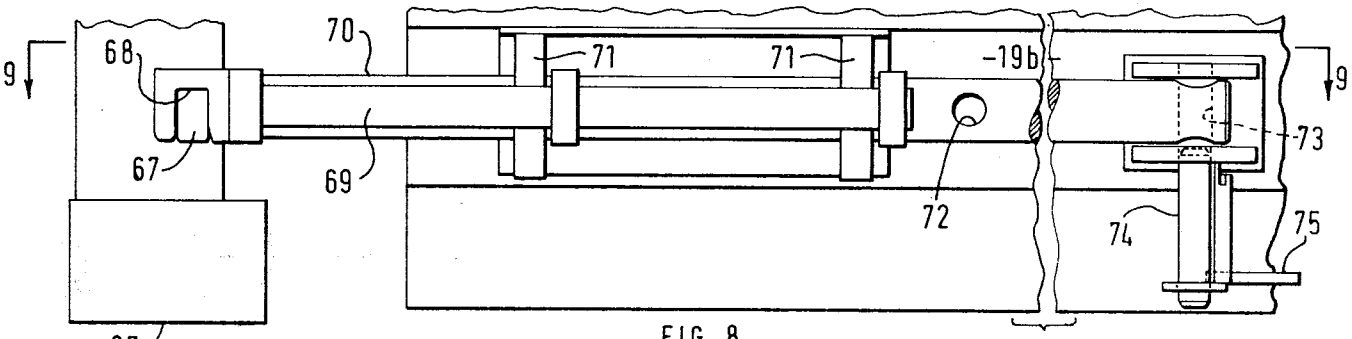
FIG. 8 is a side elevation, to an enlarged scale, similar to that of FIG. 6 but illustrating a modification to the container of FIG. 1.
Figure 9:
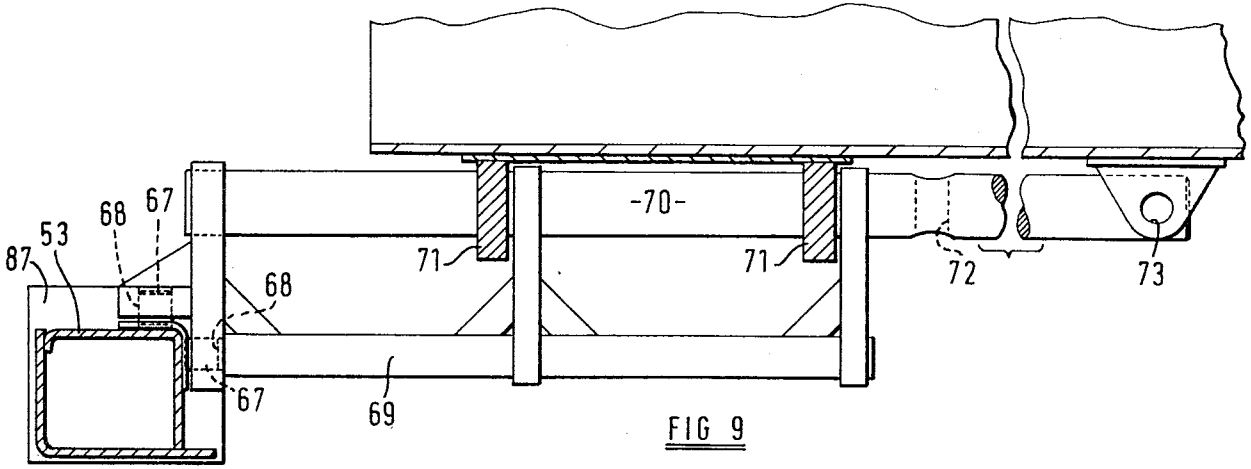
FIG. 9 is a section on the line 9—9 of FIG. 8.

If desired, the legs 53 may be retained in their operative position by locking means other than that illustrated in FIGS. 6 and 7 such as the locking means illustrated in FIGS. 8 and 9. In this case, the leg 53 is provided with two spigots 67 which are received in downwardly and horizontally opening sockets 68 provided on a locking member 69. The locking member 69 is carried on a shaft 70 which is pivotally and slidably mounted in lugs 71 provided on the beam part 19*b*. The shaft 70 is provided with a transverse bore 72 and a further transverse bore 73 extending at right angles to the bore 72. A bolt 74 is slidably mounted on the beam part 19*b* and is movable by a handle 75 which is shown in an inoperative position in FIG. 8 and an operative position where it passes through either the further bore 73 to lock the locking member 69 in its operative position or through the bore 72 to lock the locking member in its inoperative position where it is pivoted out of engagement with the spigots 67 and slid to the right in FIG. 8 so as not to project beyond the end of the body and recess R of the container thereby permitting nesting.

It will be appreciated that because the locking arrangements described in FIGS. 6 and 7 or FIGS. 8 and 9 are provided within the recesses R, they do not interfere with nesting of the containers.

Referring now again to FIG. 1, it will be seen that a retaining means 80 is provided for retaining the legs 53 in their inoperative position.

Figure 10:
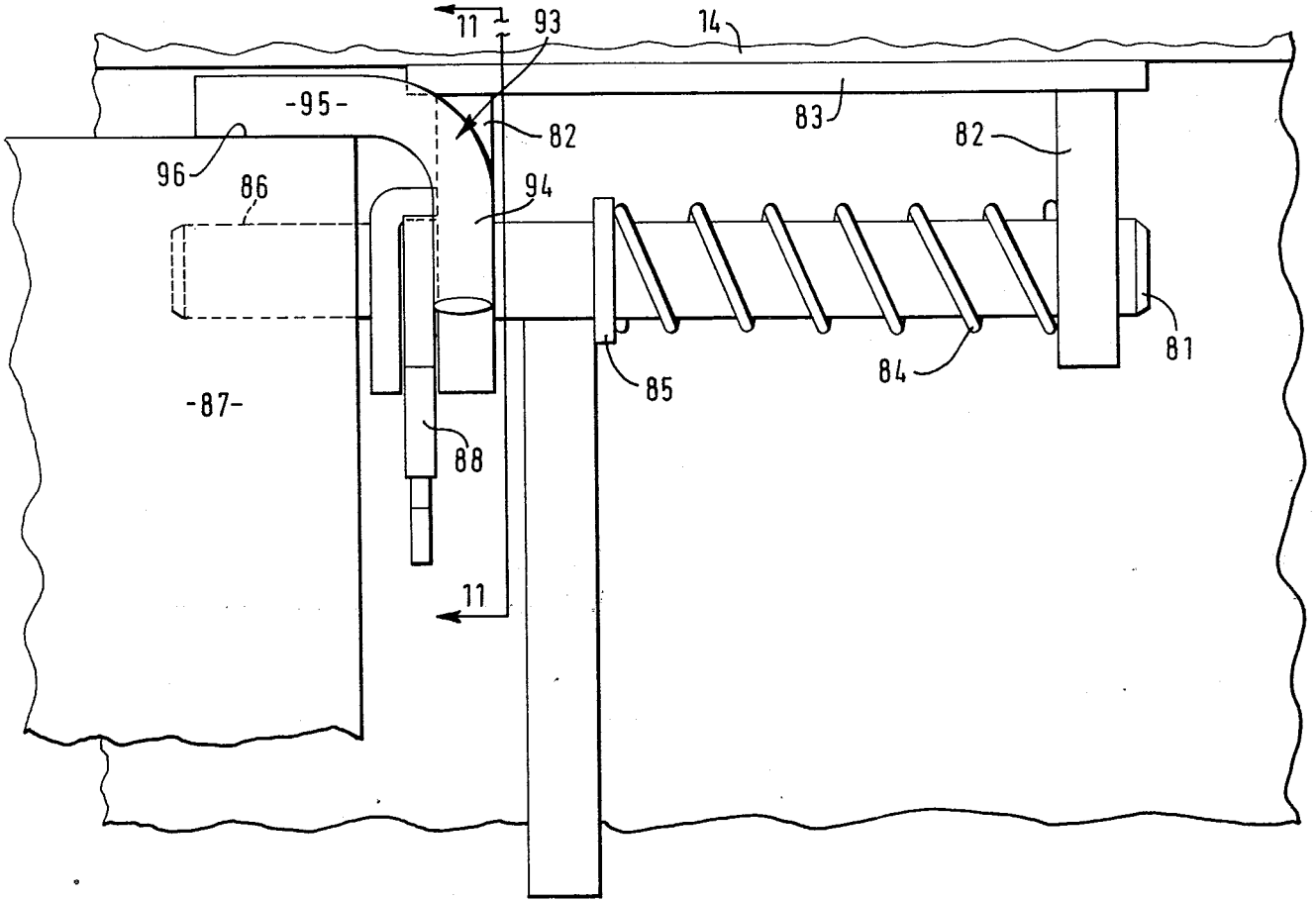
FIG. 10 is a fragmentary side elevation, to an enlarged scale, of part of the container of FIG. 1 showing a retaining means.
Figure 11:
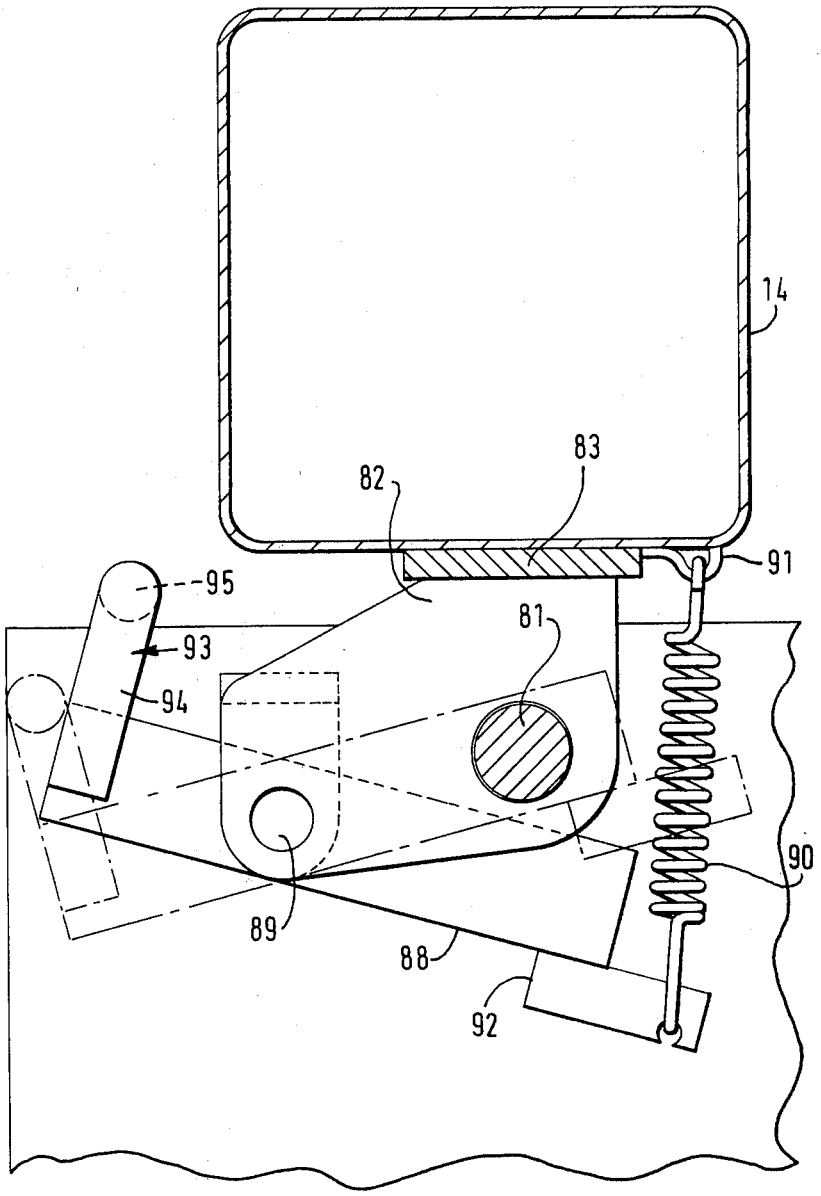
FIG. 11 is a section on the line 11—11 of FIG. 10.

Referring particularly to FIGS. 10 and 11, each retaining means comprises a bolt 81 slidably and rotatably mounted in brackets 82 depending downwardly from a plate 83 fixed to the underside of the top beam 14.

A coil compression spring 84 is engaged between a flange 85 on the bolt and the right hand of the brackets 82 normally to bias the bolt 81 into its operative position i.e. to the left in FIG. 10.

A nose portion 86 of the bolt is received within an aperture in a bottom corner casting 87 of the associated leg 53 thereby retaining the leg in its inoperative position.

Automatic means are provided to cause the nose 86 to engage with the corner casting 87 when the leg is moved to its inoperative position. This means comprises a pivoted stop lever 88, as shown in FIG. 11, which is pivoted on the bracket 82 by a pivot pin 89 and is movable into and out of a stop position, shown in chain dotted line in FIG. 11, in which it engages with the free end of the nose 86 to prevent the bolt occupying its operative position, and is normally maintained in this position by a coil tension spring 90 connected between an eye 91 on the beam 14 and an anchor member 92 on the arm 88. The lever 88 carries an abutment member 93 having a first limb 94 extending upwardly at right angles to the longitudinal axis of the stop lever 88 and a second limb 95 extending parallel to the axis of pivot of the lever 88 and in a position to be engaged by a part 96 of the corner casting 87 of the leg as it moves to its inoperative position thereby causing the stop lever 88 to pivot from the chain dotted line position shown in FIG. 11 to the full line position shown therein thus permitting the nose 86 of the bolt 81 to move into engagement with the corner casting 87 under the bias of the spring 84.

Figure 12:
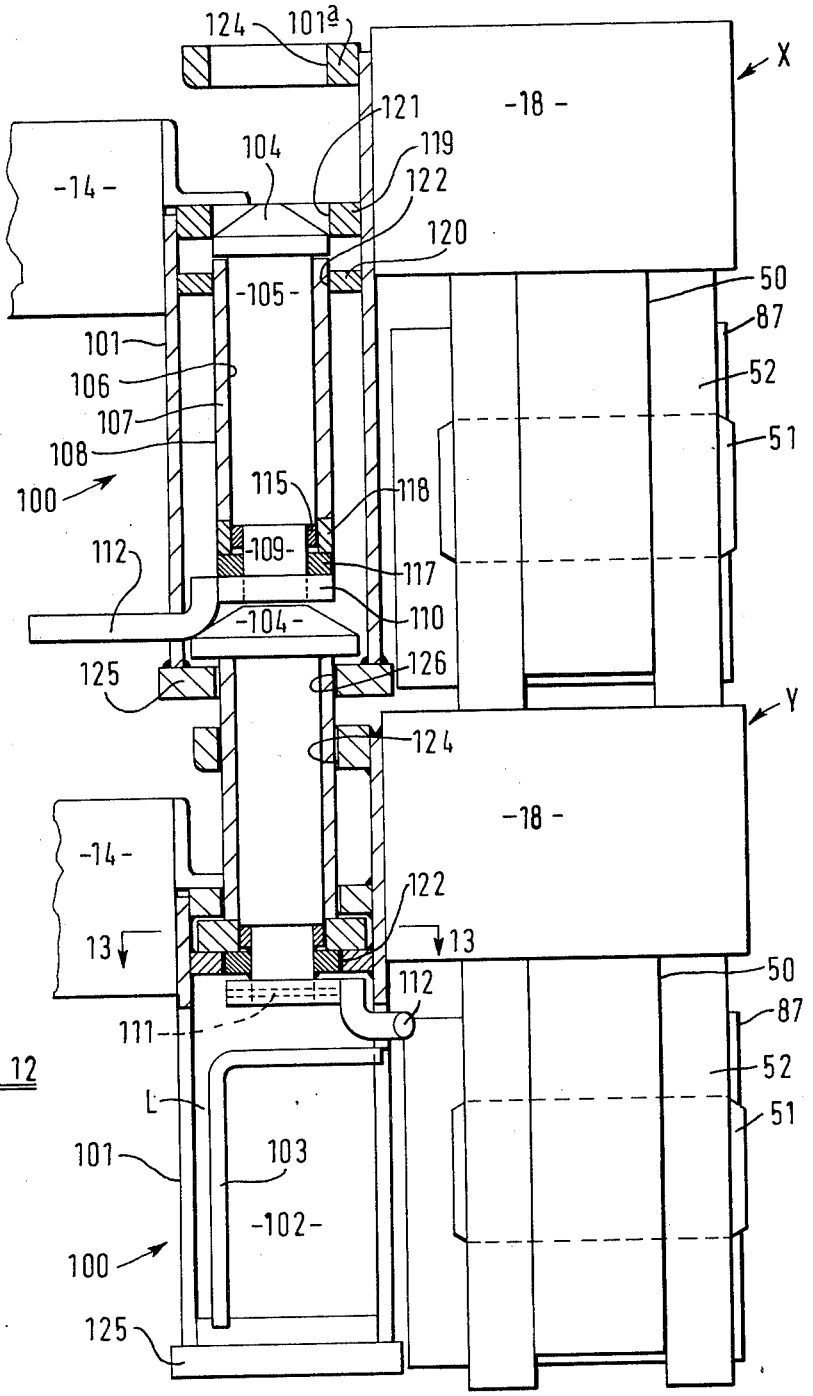
FIG. 12 is a side elevation, partly in section, illustrating two containers similar to that of FIG. 1 in a nested condition.
Figure 13:
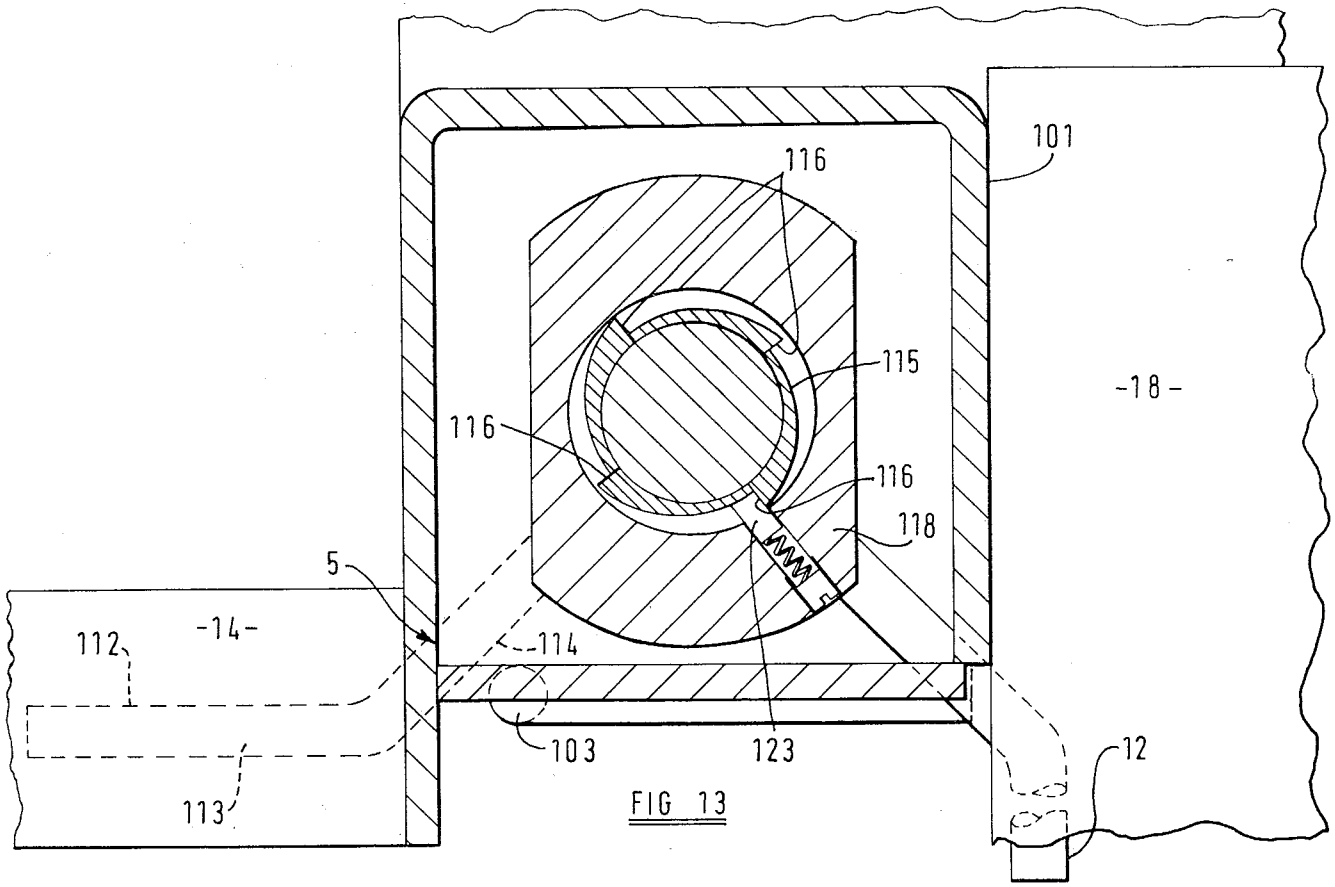
FIG. 13 is a section on the line 13—13 of FIG 12.
Figure 14:
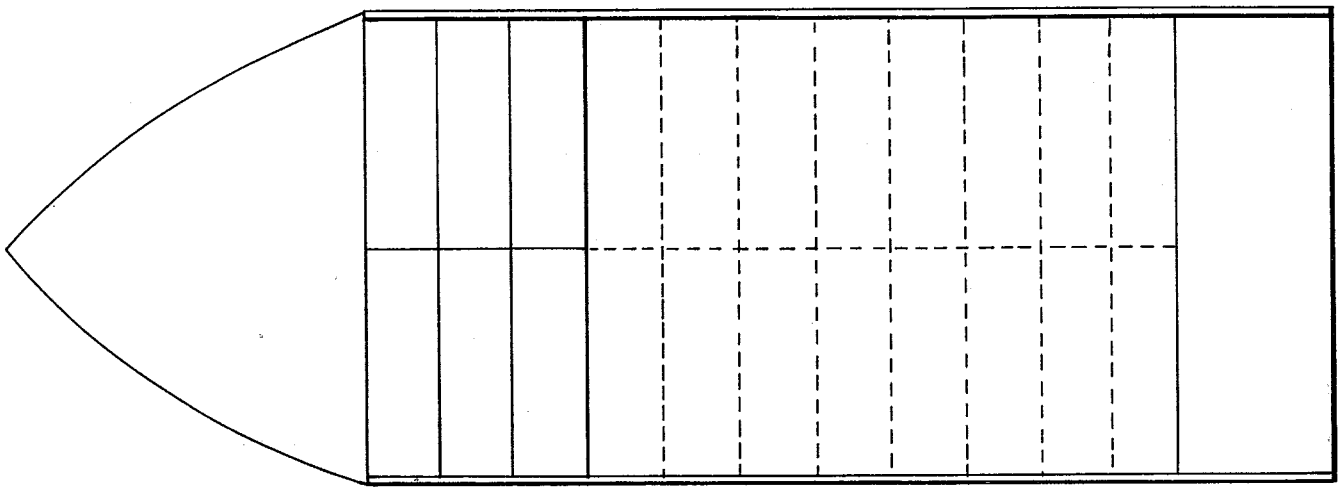
FIG. 14 is a diagrammatic plan view of a transporter.

Referring again to FIGS. 1 and 3, each upper corner box 18 carries a twist lock 100 which, as best shown in FIGS. 12 and 13, is provided so as to permit two identical containers to be locked together when they are in a nested condition.

Referring now particularly to FIG. 12, a portion of two identical containers is illustrated, each container being identical to that described hereinbefore with reference to FIGS. 1 to 3. The uppermost container is indicated at X and the lowermost container at Y and the container X is nested within the container Y and it will be seen that the upper corner box 18 of the lower container Y is contacted by the trunnions 52 of the associated leg 53 of the uppermost container X when the leg 53 is in its inoperative position.

A twist lock 100 is mounted between each corner box 18 and the associated end side beam 14. Each twist lock 100 comprises a housing 101 of generally channel configuration having an open side indicated at 102 in the housing 101 of the twist lock 100 associated with the container Y. It will be appreciated that in the drawing the housing associated with the container Y is shown in elevation at its lower part and in section at its upper part whereas the housing 101 associated with the container X is shown in section throughout except that the twist lock shank and associated handle are not shown in section.

Within each housing 101 is mounted a twist lock head 104 carried on a twist lock shank 105 of cylindrical configuration. The shank 105 is received within a cylindrical bore 106 of a sleeve 107, the external surface 108 of which is of a configuration, in horizontal section, identical to that of the major cross-section part of the head 104 and as hereinafter to be described. At its lower end the shank 106 has a reduced diameter portion 109 whih carries a collar 110 which is pinned to the reduced diameter part 109 by a pin 111 and the collar 110 has a handle 112 extending therefrom. As best shown in FIG. 13, the handle 112 has two limbs 113, 114 mutually inclined at 135°. Also fixed to the reduced cross-section part 109 is a ratchet wheel 115 having four teeth 116. A further collar 117 is welded to the part 109 and serves to retain the sleeve 107 and a locking plate 118 on the shank so that the sleeve 107 is maintained closely adjacent the underside of the head 104.

The head 104, sleeve 107 and locking plate 118 are all of the same external configuration in horizontal section, this configuration being shown in FIG. 13 which shows a cross-sectional view on the line 13—13 of FIG. 12 through the locking plate. It will be seen that the configuration is essentially rectangular except that the shorter sides of the rectangle instead of being rectilinear are part circular.

The twist lock and associated sleeve are mounted within the housing 101 by means of plates 119 and 120 each of which have an aperture 121 and 122 respectively of a configuration complementary to that of the twist lock head, sleeve and locking plate.

The locking plate 118 is provided with a spring loaded pawl 123 adapted to engage the teeth 116.

The top closure 101*a* of the housing 101 is provided with an aperture 124 of the same configuration as the apertures 121 and 122 and which serves to support and guide the sleeve of the twist lock when it is in its extended position as shown in FIG. 12 with regard to container Y.

The bottom closure 125 of the housing 101 is also provided with an aperture 126 of the same configuration as the apertures 121, 122 and 124 which permits passage of the head 104 of the twist lock when it is in its nonlocking position and prevents passage when it is in its locking position thereby locking the upper twist lock housing to the lower twist lock and hence locking the two containers together.

In use, assuming that the twist lock is in its inoperative position i.e. that shown in FIG. 12 with regard to the container X, the handle 112 will be at the lower end of the slot L provided between the wall of the housing 101 and the guide 103 as shown in FIG. 12 with regard to the container X and in dotted line in FIG. 13. The handle 112 is then grasped to raise the twist lock shank, sleeve and locking plate and this is permitted since passage of these components through the openings 121, 122, 124 and 126 can occur since all the components are circumferentially aligned in such a manner as to pass through the openings. When the handle 112 has been raised so as to be aligned with the horizontal limb of the guide 103, it is rotated anti-clockwise to the position shown in FIG. 12 in association with the container Y and which is also shown in full line in FIG. 13.

This rotation of the handle, through 90°, turns the head of the twist lock through 90° in an anti-clockwise direction looking from above i.e. to the position shown in FIG. 12 (container Y). If the handle 112 is now turned back through 90° in a clockwise direction, the head of the twist lock will be moved to its unlocked position shown in FIG. 12 (container X) but the locking plate will be rotated through 90°, as a result of engagement of one of the teeth 116 of the ratchet 115 with the pawl 123 and hence locking plate 118 will be moved to the position shown in FIG. 12 (container Y) where it cannot pass downwardly through the aperture 122. Hence the twist lock will now be held in its extended position but with the head in an unlocked position thereby enabling a second container i.e. container X, to be nested in the first i.e. container Y, and to be guided into position by the taper provided on the head of the twist lock of container Y.

Upon rotation of the handle 112 again anti-clockwise through 90°, the twist lock head will be moved into the locked position as shown in FIG. 12 (container Y) whilst leaving the locking plate in its locked position and hence the two containers will then be locked together as shown in connection with the containers X and Y in FIG. 12.

To unlock the twist lock and to retract it, it is merely necessary to rotate the handle 112 again clockwise through 90° to unlock the head and also to rotate the locking plate through a further 90° as a result of engagement between a tooth and the pawl so that the locking plate is allowed to pass through the aperture 122 to permit the shank and head of the twist lock to return to its inoperative position shown in FIG. 12 (container X).

It will be appreciated therefore that the twist locks can thus be used both to locate a second container nested in a first container and also to lock such a second container to the first. It will be appreciated that the twist lock of the first or lowermost container i.e. the container Y of FIG. 12, can be operated regardless of the position of the twist lock of the second or upper container i.e. the container X of FIG. 12. Furthermore, the twist lock of the container Y can be used to lock the container X to the container Y even if the twist lock of container Y is originally in its inoperative position and the container X is already nested within the container Y. In other words, the twist lock of the container Y need not be in its locating position whilst the container X is being nested within the container Y.

Suitable covering means such as a tarpaulin or removable rigid cover is provided to close the top of the body when in use to transport articles and is latched to eyes 17 and other eyes 17*a* along the sides and ends of the top beams 14.

In use, a plurality of containers 10 are filled with articles to be transported and covered with a covering means as described hereinbefore. With the legs 53 in their operative position, the containers are stacked, in a transporter such as the hold of a ship with the corner castings 87 of the legs 53 engaging the upper surface of the upper corner boxes 18 at the corners C. Thus the weight of the body 11 of a container is supported by its legs 53, the bottom castings 87 of each leg 53 being arranged to transmit the weight to the upper end of a similar leg of a container below by virtue of engagement with the upper surface of the upper corner box 18 of the container next below and via a load transmitting connection between the leg 53 and corner box 18. For example, in the container illustrated, this is the pin 51 but it could be by virtue of a clearance in the pin connection by engagement between an upwardly facing abutment surface on the leg and downwardly facing end of the mounting lug 50.

The containers may, for example, be arranged in eleven stacks of nine containers.

When the stacks of full containers have been emptied at a destination, the legs 53 are folded to the inoperative position and then the containers are arranged in three columns with the bodies 11 nesting one within the other but with the bottom container of the nested column having its legs in the operative position to transmit the weight of the column to the floor. Each column can contain upto thirty three containers. The space thus not occupied by containers is then available for the transport of other articles. Thus the cost of "dead heading" the containers in empty condition can be off-set by the remuneration received for transport of freight in the majority of the transporter not now occupied by the nested containers.

It should be appreciated that the legs of the container may be provided in any other desired manner, the only requirement being that the legs can be moved between a position in which they carry the weight of the body and an inoperative position in which the containers can be nested. For example, the legs could be pivoted about an axis at 90° to that shown in FIG. 1 so that they can be folded transversely of the container instead of longitudinally. Alternatively, the legs may be pivoted intermediate their ends so that they can be folded so that the parts lie parallel to each other and to the top of the container.

The containers can also be provided with any other features desired including those commonly provided on containers such as ISO corner castings, lifting hooks, fork lift pockets and the like.

Means may be provided to lock the containers together when they are stacked such as double-ended twistlocks interposed between stacked boxes 18 and castings 87 or by providing suitable permanent twistlocks.

I claim:

1. A container comprising a load receiving body having a length of at least 3 meters and comprising an open topped box having a base wall and downwardly and inwardly inclined sidewalls whereby the body of a similar container can be nested therein, the body having retractable leg means comprising a plurality of fixed leg parts provided externally of the body at the upper end of the body, a movable leg pivotally connected at the upper end thereof to each fixed leg part adjacent the upper end of the body for movement between an operative position, in which the movable legs extend downwardly and the lower ends thereof project below the base wall of the body and are adapted to support the weight of the body and to engage said fixed leg parts of a similar container there below upon which said one container is thereby stacked, to transmit said weight thereto, and an inoperative position in which said movable legs extend generally parallel to the top of the container and in which the bodies can be nested, leg locking means being provided rigidly to hold each movable leg in said operative position, first locking means to permit the container to be locked to a similar container when in nested relationship therewith and second locking means to permit the container to be locked to a similar container when in stacked relation therewith.

2. The invention claimed in claim 1 wherein each leg is pivotally connected to the body for movement about a horizontal axis.

3. The invention claimed in claim 2 wherein the body is rectangular in plan view and each leg lies parallel to a longer side of the body when it is in its inoperative position.

4. The invention claimed in claim 1 wherein the locking means comprises an arm pivotally mounted on the body for movement about a vertical axis between an operative position wherein an end of the arm is in locking engagement with the leg and an inoperative position wherein the arm permits pivotal movement of the leg.

5. The invention claimed in claim 1 wherein the locking means comprises a locking member mounted on the body for pivotal and sliding movement about a horizontal axis parallel to a side wall of the body, said locking member and leg having spigot and socket means which can be engaged to lock the leg in its operative position by sliding the locking member axially towards the leg from an inoperative position and then pivoting the locking member to engage the spigot and socket connection.

6. The invention claimed in claim 5 wherein securing means are provided for securing the locking member in at least one of its operative and inoperative positions.

7. The invention claimed in claim 1 wherein retaining means are provided to hold each leg in its inoperative position.

8. The invention claimed in claim 7 wherein the retaining means comprises a shoot bolted connection between a lower part of a leg and a part of the body adjacent thereto when the leg is in its inoperative position.

9. A container as claimed in claim 1 wherein said first and second locking means comprise twist locks.

10. The invention claimed in claim 1 wherein at least one side wall is hinged about a horizontal axis to permit access to be gained to the interior of the container from said side.

11. The invention claimed in claim 1 wherein at least one side wall of the container is of ribbed configuration and the ribs being tapered longitudinally and transversely whereby the corresponding ribs of another container can be arranged in nested relationship with said ribs when said other container is nested within said one container.

* * * * *